US012215681B2

(12) United States Patent
Chou et al.

(10) Patent No.: US 12,215,681 B2
(45) **Date of Patent: *Feb. 4, 2025**

(54) AIR STOP SHEET OF PISTON OF CYLINDER

(71) Applicants: Wen-San Chou, Tainan (TW); Cheng-Hsien Chou, Tainan (TW)

(72) Inventors: Wen-San Chou, Tainan (TW); Cheng-Hsien Chou, Tainan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/719,744

(22) Filed: Apr. 13, 2022

(65) Prior Publication Data

US 2022/0341410 A1 Oct. 27, 2022

(30) Foreign Application Priority Data

Apr. 22, 2021 (TW) ..... 110114607

(51) Int. Cl.
*F04B 39/08* (2006.01)
*F04B 39/00* (2006.01)
*F04B 39/10* (2006.01)

(52) U.S. Cl.
CPC ..... *F04B 39/0016* (2013.01); *F04B 39/08* (2013.01); *F04B 39/1073* (2013.01)

(58) Field of Classification Search
CPC .. F04B 35/04; F04B 39/0016; F04B 39/1033; F04B 39/1073; F04B 53/1037;
(Continued)

(56) References Cited

U.S. PATENT DOCUMENTS 2,106,775 A * 2/1938 Trask ..... F04B 39/0016 137/854
2,800,170 A * 7/1957 Richardson ..... A47C 27/04 112/420

(Continued)

FOREIGN PATENT DOCUMENTS

DE 19834140 8/1999
EP 1437508 10/2006

(Continued)

OTHER PUBLICATIONS

"Search Report of Europe Counterpart Application", issued on Sep. 21, 2022, p. 1-p. 7.

(Continued)

*Primary Examiner* — Kenneth J Hansen
*Assistant Examiner* — Chirag Jariwala
(74) *Attorney, Agent, or Firm* — JCIPRNET

(57) ABSTRACT

An air stop sheet of a piston of a cylinder, the piston is accommodated in an air compressor, and an air stop sheet is accommodated on a head of the piston. The air stop sheet includes a bending section having a positioning zone and an acting zone and configured to be a boundary line of the acting zone and the positioning zone. The acting zone backing the cylinder turns on relative to the plane of the head at an open angle θ, thus producing an air flowing space. A piston rod extends downward from the head and includes a cavity, an air conduit, a column, and a spring configured to abut against the acting zone of the air stop sheet. The air stop sheet is pushed by the spring to turn on at an open angle θ, and the air conduit and the air channel communicate with atmosphere.

3 Claims, 9 Drawing Sheets

(58) Field of Classification Search
CPC ..... F04B 53/123; F04B 53/128; F04B 39/10; F04B 39/108; F04B 39/1086; F04B 53/12; F04B 39/08; F04B 53/105; F16K 15/161; Y10T 137/7869
USPC ..... 92/183; 417/550
See application file for complete search history.

(56) References Cited

U.S. PATENT DOCUMENTS

| | | | | |
|---|---|---|---|---|
| 4,275,999 | A * | 6/1981 | Hetzel et al. | F04B 39/0016 417/299 |
| 4,642,037 | A | 2/1987 | Fritchman | |
| 6,823,891 | B2 * | 11/2004 | Schulze | F16K 15/16 137/512 |
| 7,318,451 | B2 * | 1/2008 | Peric et al. | F16K 15/16 165/280 |
| 2003/0206817 | A1 * | 11/2003 | Oh et al. | F16K 15/16 417/559 |
| 2007/0264140 | A1 * | 11/2007 | Chou | F04B 39/0016 417/415 |
| 2008/0202613 | A1 * | 8/2008 | Yamaoka et al. | F04B 39/1073 417/569 |
| 2015/0246490 | A1 * | 9/2015 | Kono et al. | F04B 39/0016 417/444 |

FOREIGN PATENT DOCUMENTS

| | | | | |
|---|---|---|---|---|
| EP | 2955383 | A1 * | 12/2015 | F04B 35/06 |
| FR | 704918 | | 5/1931 | |
| FR | 2216462 | | 8/1974 | |
| JP | S5312607 | | 2/1978 | |
| JP | H0791376 | | 4/1995 | |
| JP | H07103138 | | 4/1995 | |
| JP | H11230042 | | 8/1999 | |
| JP | H-11230042 | A * | 8/1999 | F04B 39/10 |
| JP | 3204159 | | 5/2016 | |
| JP | 2017129140 | | 7/2017 | |
| JP | 3237974 | | 6/2022 | |
| KR | 100455193 | | 11/2004 | |
| KR | 20050017240 | | 2/2005 | |
| KR | 100690906 | B1 * | 3/2007 | F04B 39/00 |
| KR | 100880303 | | 1/2009 | |
| WO | 2017173715 | | 10/2017 | |
| WO | WO-2017173715 | A1 * | 10/2017 | F04B 53/02 |

OTHER PUBLICATIONS

"Office Action of Japan Counterpart Application", issued on May 9, 2023, p. 1-p. 7.
"Office Action of Korea Counterpart Application", issued on Nov. 21, 2023, p. 1-p. 6.

* cited by examiner

AIR STOP SHEET OF PISTON OF CYLINDER

FIELD OF THE INVENTION

The present invention relates to an air compressor, and more particularly to the air compressor which includes an air stop sheet and a piston moving upward and downward in a cylinder of an air compressor.

BACKGROUND OF THE INVENTION

A conventional air compressor contains: a motor, a piston driven by the motor to move reciprocately in a cylinder, such that air are compressed to produce compressed air, and the compressed airs are delivered to a storage holder from the cylinder, thereafter the compressed air are inflated into a deflated object via an output tube of the storage holder via a delivery hose connected with the output tube. The piston includes a conduit communicating with a head thereof, an air stop sheet covered on the conduit of a plane of a top of the piston. When the air compressor stops, the air stop sheet closes the conduit of the head of the piston. After the air compressor operates again, airtightness produces among an airtight ring and the air stop sheet of the head of the piston and the air stop sheet, so the compressed air cannot be discharged out of the cylinder completely. After starting the air compressor once more, the piston presses against the compressed air already in the cylinder which increases loading and electric currents of the air compressor, thus reducing a service life of the air compressor.

The present invention has arisen to mitigate and/or obviate the afore-described disadvantages.

SUMMARY OF THE INVENTION

The primary aspect of the present invention is to provide an air stop sheet of a piston of a cylinder by which when the piston of the air compressor stops, the acting zone of the air stop sheet lifts relative to the air channel and the air conduit, and the air channel of the piston is communicated smoothly so that a pressure of the cylinder balances with atmosphere, and the piston is not stopped by an additional resistance (i.e. a back-pressure resistance) in the upward moving stroke after the air compressor is opened again, thus enhancing using safety and service life and inflating the compressed air into the deflated object easily.

Further aspect of the present invention is to provide an air stop sheet of a piston of a cylinder by which when the piston of the air compressor stops, the acting zone of the air stop sheet lifts relative to the plane of the top of the head.

Another aspect of the present invention is to provide an air stop sheet of a piston of a cylinder by which the head includes the two separated bolts, and the positioning zone of the air stop sheet has two spaced orifices connecting with the two separated bolts of the head, thus fixing the air stop sheet on the head.

To obtain above-mentioned aspect, an air stop sheet of a piston of a cylinder provided by the present invention contains at least one bending section. The bending section has a positioning zone arranged on a first side thereof and located on the plane of the top of the head, and the bending section further has an acting zone arranged on a second side thereof and configured to close an air channel of the piston. The bending section is a boundary line of the acting zone and the positioning zone of the air stop sheet so that a positive surface of the air stop sheet forms an obtuse angle less than 180 degrees, and a back surface of the acting zone of the air stop sheet backing the top of the cylinder lifts relative to the plane of the top of the head at an open angle θ, thus producing an air flowing space.

A piston rod extends downward from the head, and the piston rod includes a cavity defined on a top thereof, an air conduit defined in the cavity and communicating with the air channel of the head, a column extending from a bottom of the cavity, and a spring fitted on the column and extending through the air channel of the head along the cavity of the piston rod so that the spring abuts against the back surface of the acting zone of the air stop sheet, the air stop sheet is pushed by the spring to turn on at an open angle θ, and the air conduit and the air channel communicate with atmosphere.

Another aspect of the present invention is to provide a piston of an air compressor which contains the bending section of the air stop sheet having at least one collapsible guide line, and a number of the at least one collapsible guide line are determined based on an output power of the air compressor.

DETAILED DESCRIPTION OF THE PREFERRED EMBODIMENTS

Figure 5:
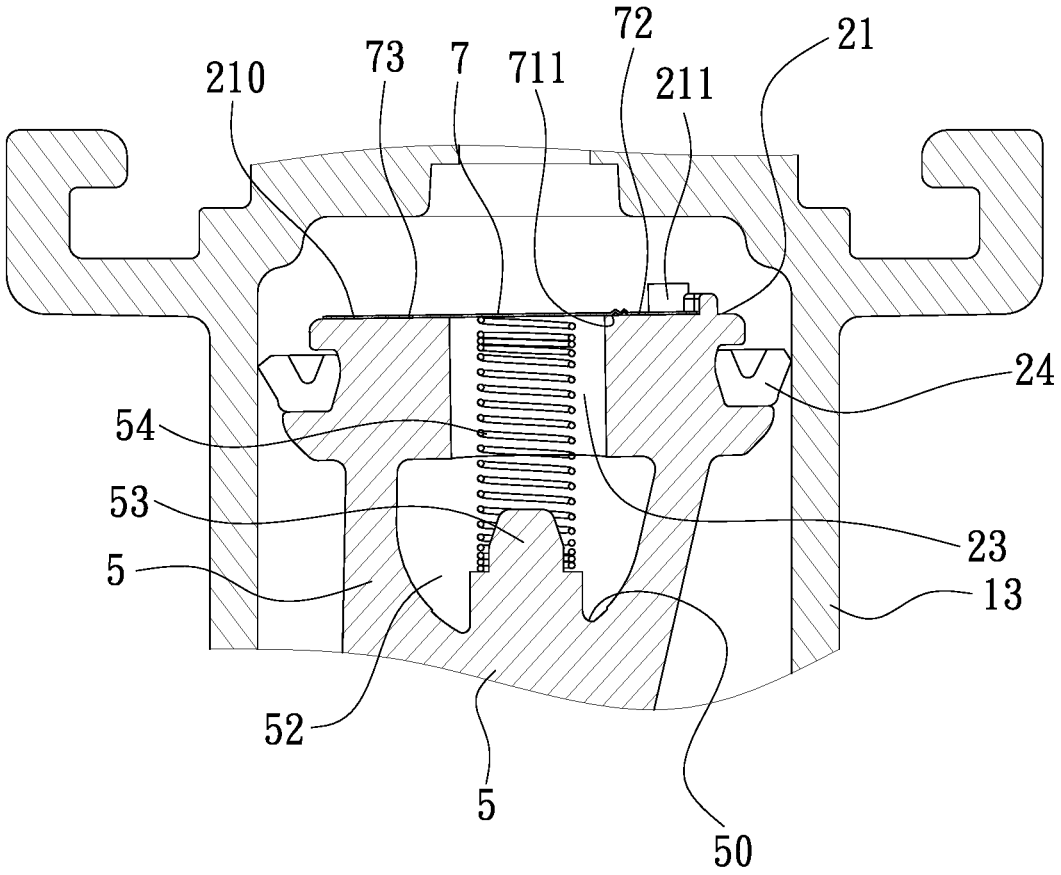
FIG. 5 is an amplified cross sectional view showing the operation of the piston of the air compressor according to the preferred embodiment of the present invention.
Figure 6:
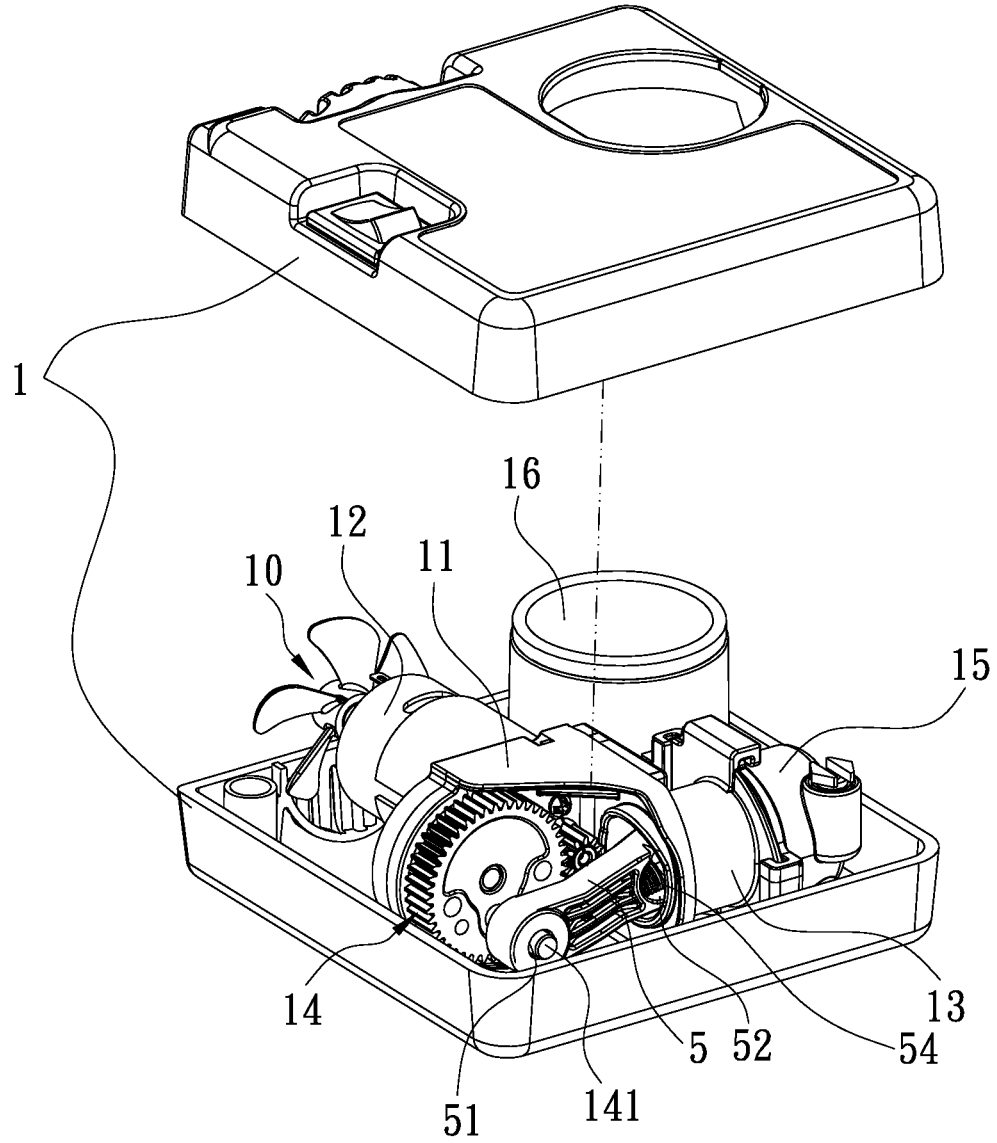
FIG. 6 is a perspective view showing the exploded components of the air compressor according to the preferred embodiment of the present invention.

With reference to FIG. 6, an air compressor 10 according to a preferred embodiment of the present invention is received in an accommodation chamber, a box 1 or other a work place. In this embodiment, as shown in FIG. 6, the box 1 receives the air compressor 10 configured to inflate air or to connect with a sealant supply (not shown), thus inflating the air and supplying sealant. The air compressor 10 includes a substrate 11 configured to fix a motor 12, a cylinder 13 connected on the substrate 11, a transmission mechanism 14 mounted on the substrate 11 and connected with a piston. Referring to FIGS. 1 to 5, the piston includes a head 21, a plane 210 formed a top of the head 21, a seal ring 24 mounted around an outer wall of the head 21 and configured to close the piston and the cylinder 13 when the air compressor operates, and an air channel 23 communicating with the head 21. A piston rod 5 extends downward from the head 21, and the piston rod 5 includes a circular orifice 51 defined on a bottom thereof and rotatably connected with a crankshaft 141 of the transmission mechanism 14. The piston rod 5 also includes a cavity 50 defined on a top thereof, an air conduit 52 defined in the cavity 50 and communicating with the air channel 23 of the head 21, a column 53 extending from a bottom of the cavity 50, and a spring 54 fitted on the column 53 and extending through the air channel 23 of the head 21 along the cavity 50 of the piston rod 5 so that the spring 54 abuts against a back surface of the acting zone 73 of the air stop sheet 7, the air stop sheet 7 is pushed by the spring 54 to turn on at an open angle θ, and the air conduit 52 and the air channel 23 communicate with atmosphere. When an output shaft of the motor 12 actuates the crankshaft 141 of the transmission mechanism 14 to rotate and the piston to move upward and downward in the cylinder 13, the air are compressed to produce compressed air, and the compressed airs flow into a storage holder 15 (see FIG. 6) so as to be supplied into a pressure gauge 16 via a delivery pipe, thus displaying a pressure. Thereafter, the compressed air are inflated into a deflated object (not shown) via an air hose. Alternatively, the compressed air and sealant are supplied to a broken tire (not shown) via the air hose or a valve. Since it is well-known art, further remarks are omitted.

Figure 1:
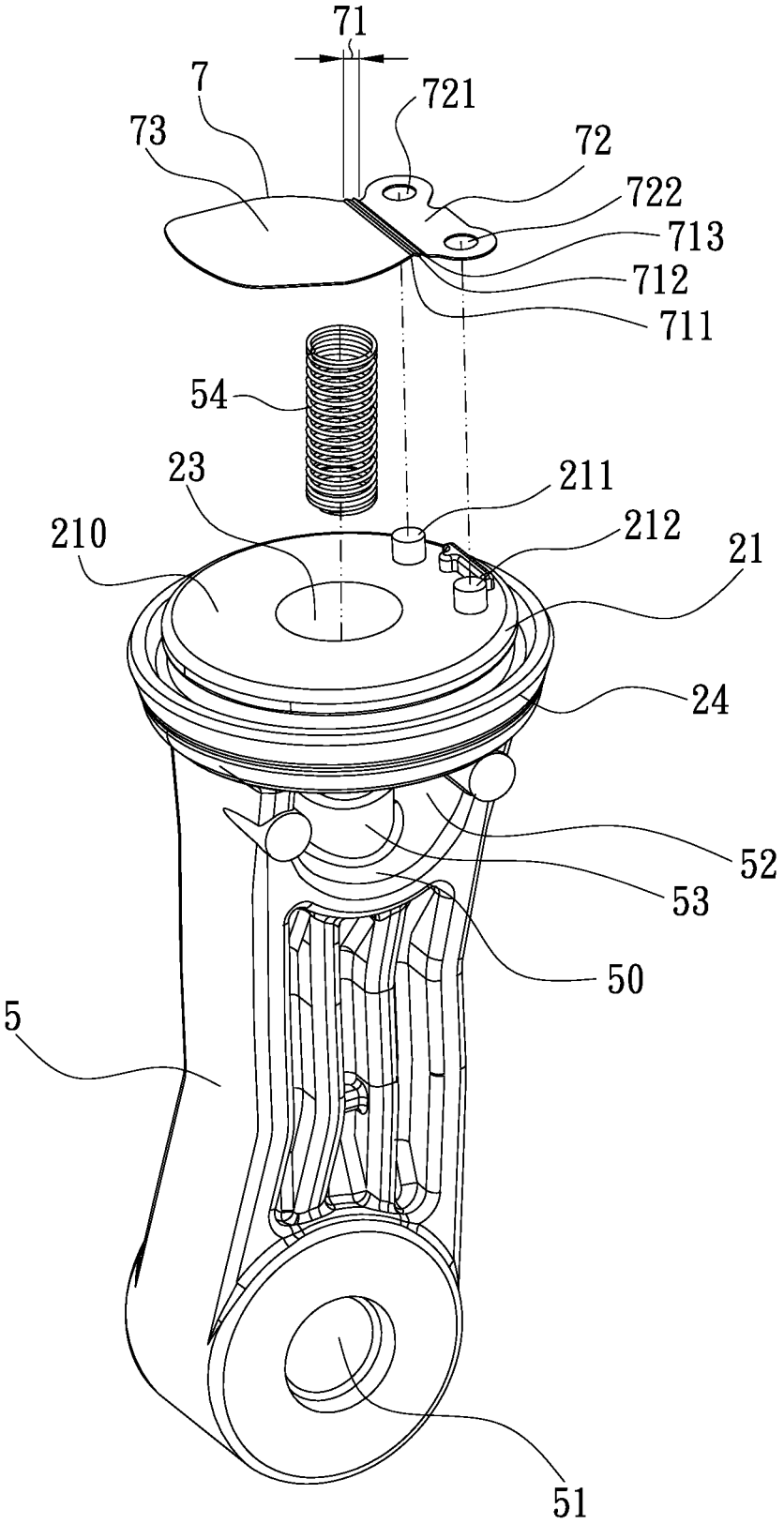
FIG. 1 is a perspective view showing the exploded components of a piston, a spring and an air stop sheet according to a preferred embodiment of the present invention.
Figure 2:
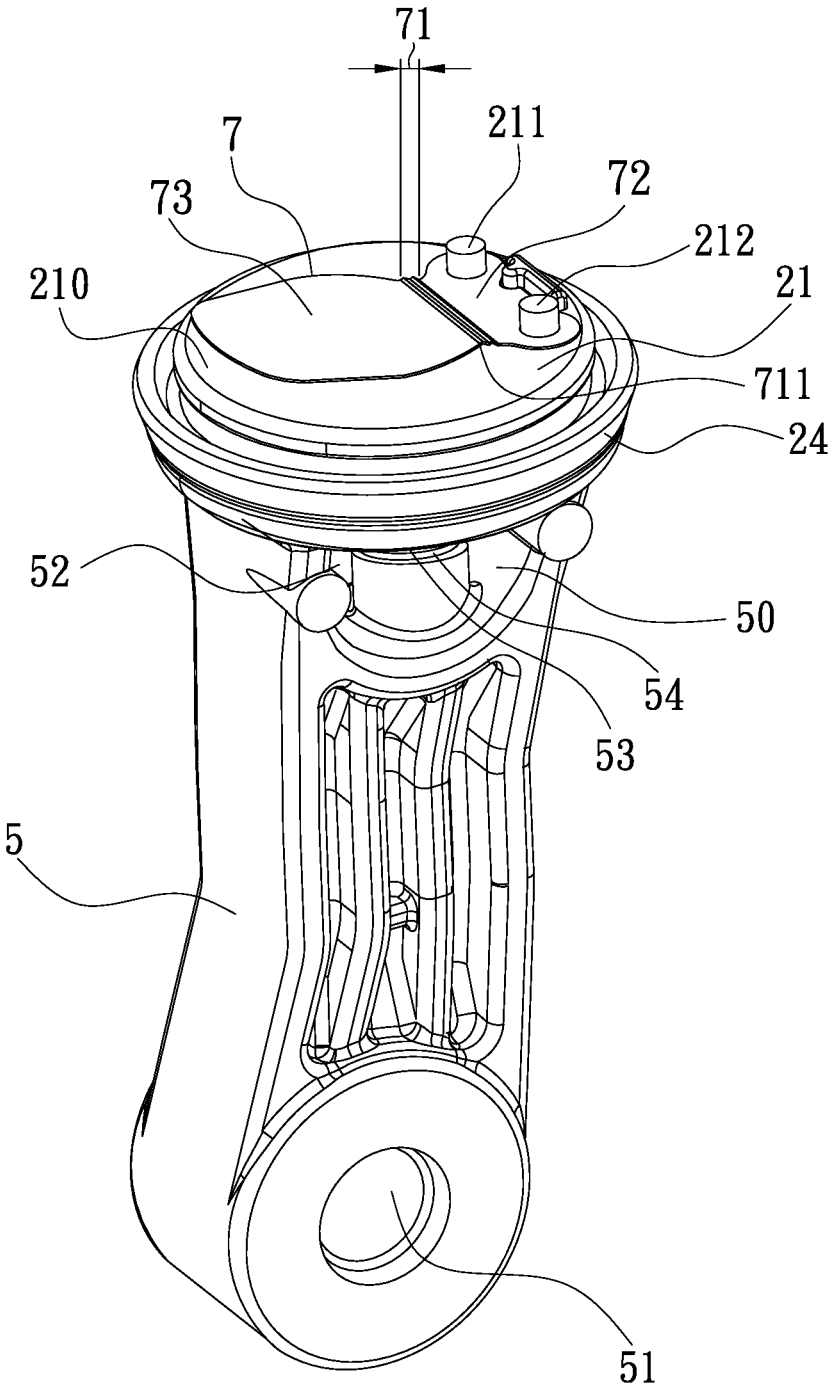
FIG. 2 is a perspective view showing the assembly of the piston, the spring, and the air stop sheet according to the preferred embodiment of the present invention.
Figure 3:
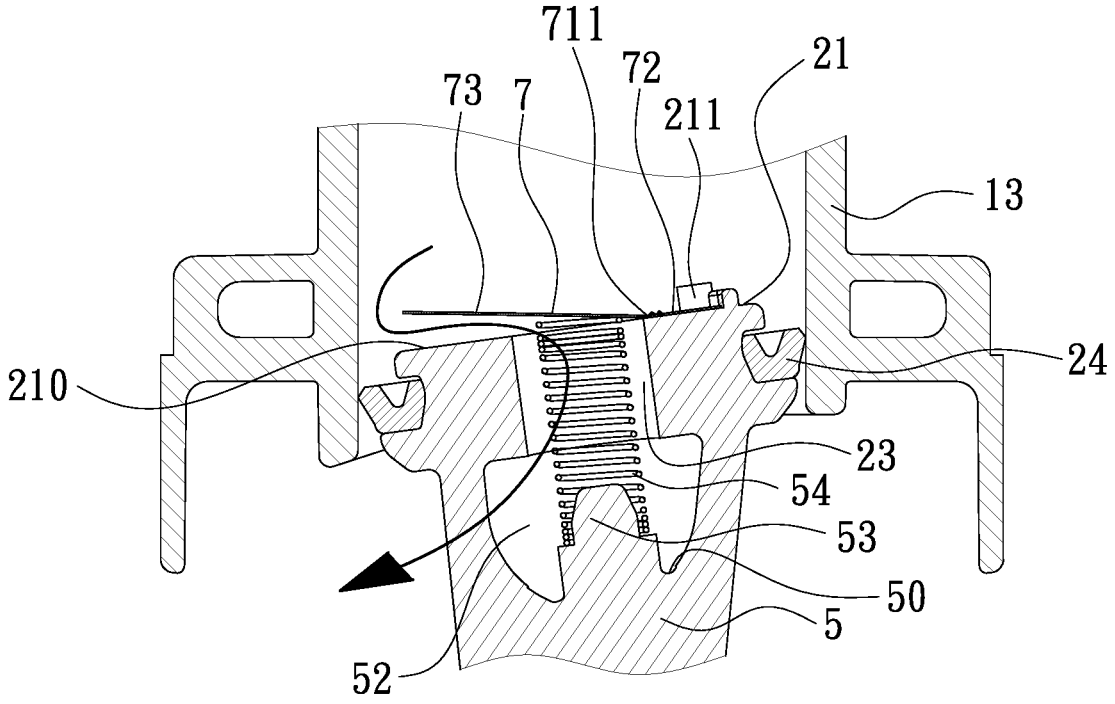
FIG. 3 is a cross sectional view showing the operation of the piston of the air compressor according to the preferred embodiment of the present invention.
Figure 4:
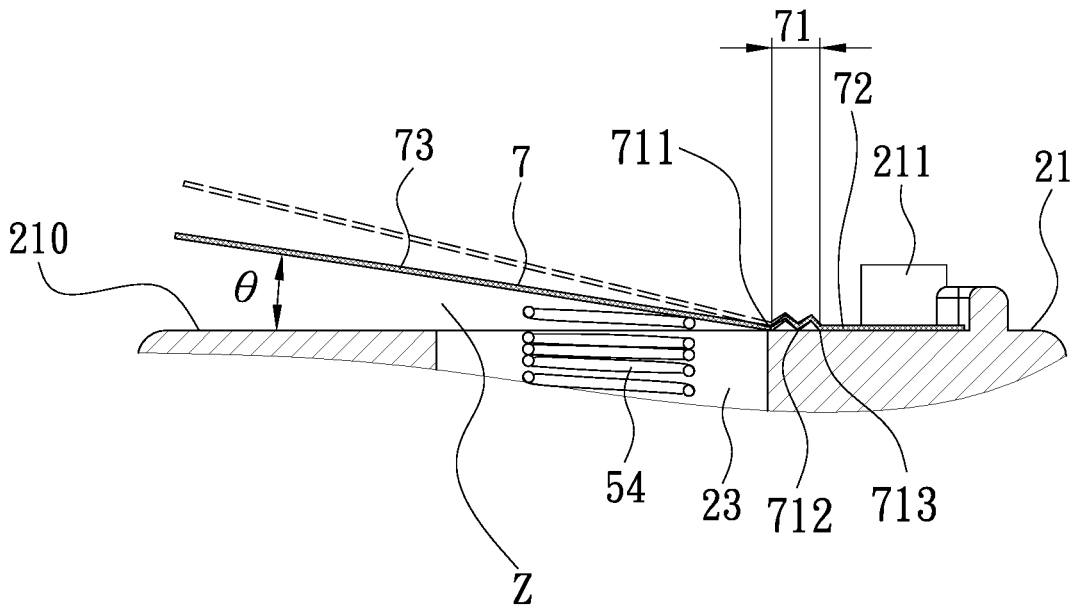
FIG. 4 is an amplified cross sectional view showing the assembly of a part of the piston of the air compressor according to the preferred embodiment of the present invention.

The head 21 of the piston of the air compressor 10 accommodates an air stop sheet 7, and the air stop sheet 7 includes a bending section 71, wherein the bending section 71 is formed in a mechanical working manner and has at least one collapsible guide line, for example, the bending section 71 has a first collapsible guide line 711, a second collapsible guide line 712, and a third collapsible guide line 713, as shown in FIG. 4, hence a number of the at least one collapsible guide line is determined based on an output power of the air compressor, and when an external pressure acts to the air stop sheet 7, the air stop sheet 7 opens and closes the piston by using the at least one collapsible guide line (track). The bending section 71 has a positioning zone 72 arranged on a first side thereof and located on the head 21, wherein the head 21 includes the two separated bolts 211, 212, and the positioning zone 72 of the air stop sheet 7 has two spaced orifices 721, 722 connecting with the two separated bolts 211, 212 of the head 21, thus fixing the air stop sheet 7 on the head 21. The bending section 71 further has the acting zone 73 arranged on a second side thereof and configured to close the air channel 23 of the piston. The bending section 71 is a boundary line of the acting zone 73 and the positioning zone 72 of the air stop sheet 7 so that a positive surface of the air stop sheet 7 (i.e. the air stop sheet 7 facing a top of the cylinder 13 in an upward moving stroke) forms an obtuse angle less than 180 degrees, and the back surface of the acting zone 73 of the air stop sheet 7 backing the top of the cylinder 13 lifts relative to the plane 210 of the top of the head 21 at an open angle θ, thus producing an air flowing space Z, such that when the piston of the air compressor 10 stops, the acting zone 73 of the air stop sheet 7 lifts relative to the air channel 23 and the air conduit 52, as shown in FIGS. 3 and 4. Furthermore, the spring 54 abuts against the back surface of the acting zone 73 of the air stop sheet 7 so that the air stop sheet 7 turns on relative to the plane of the top of the head 21 to produce the flowing space Z, wherein the air stop sheet 7 includes the bending section 71, and the spring 54 abuts against the back surface of the acting zone 73 of the air stop sheet 7, so when the air stop sheet 7 lifts or the head 21 stops, the air stop sheet 7 operates smoothly to avoid a flexibility fatigue. Preferably, the air channel 23 of the piston is communicated smoothly so that a pressure of the cylinder 13 balances with the atmosphere, and the piston is not stopped by an additional resistance (i.e. a back-pressure resistance) in the upward moving stroke (as shown in FIG. 5) after the air compressor 10 is opened again, thus enhancing using safety and service life and inflating the compressed air into the deflated object easily. FIGS. 3 and FIG. 5 show the piston moving in the upward moving stroke and the downward moving stroke. As shown in FIG. 5, the spring 6 is pressed and the acting zone 73 of the air stop sheet 7 closes the air channel 23, when the piston moves in the upward moving stroke. As illustrated in FIGS. 3 and 4, when the piston moves in the downward moving stroke, the spring 6 expands to push the acting zone 73 and the bending section 71 of the air stop sheet 7 away from the air channel 23. Referring to FIG. 3, when the piston stops, the spring 6 expands to push the acting zone 73 of the air stop sheet 7 to open at the open angle θ. Thereby, residual high-pressure air discharge via the air flowing space Z and the air channel 23, and the pressure of the cylinder 12 balances with the atmospheric so as to overcome the back-pressure resistance of the air stop sheet 7, when the piston operates again.

Figure 7:
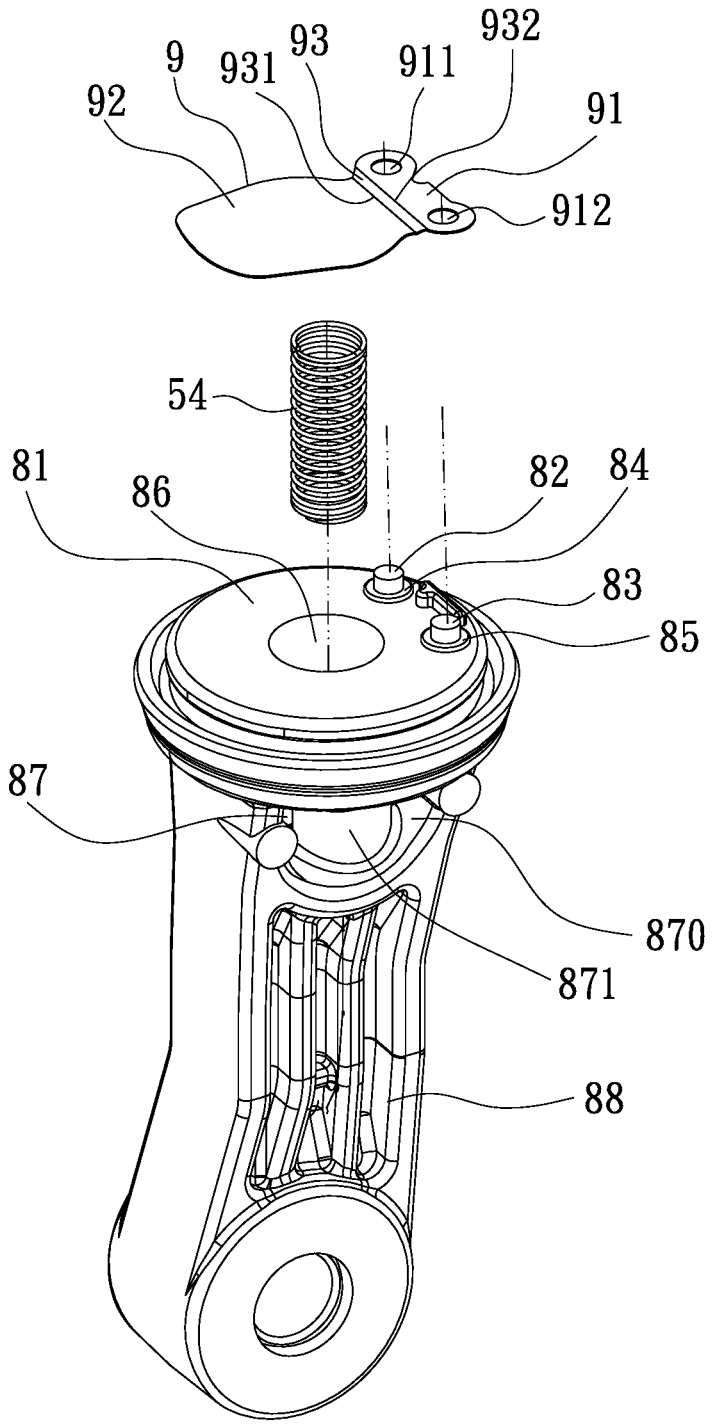
FIG. 7 is a perspective view showing the exploded components of a piston of an air compressor according to another preferred embodiment of the present invention.
Figure 8:
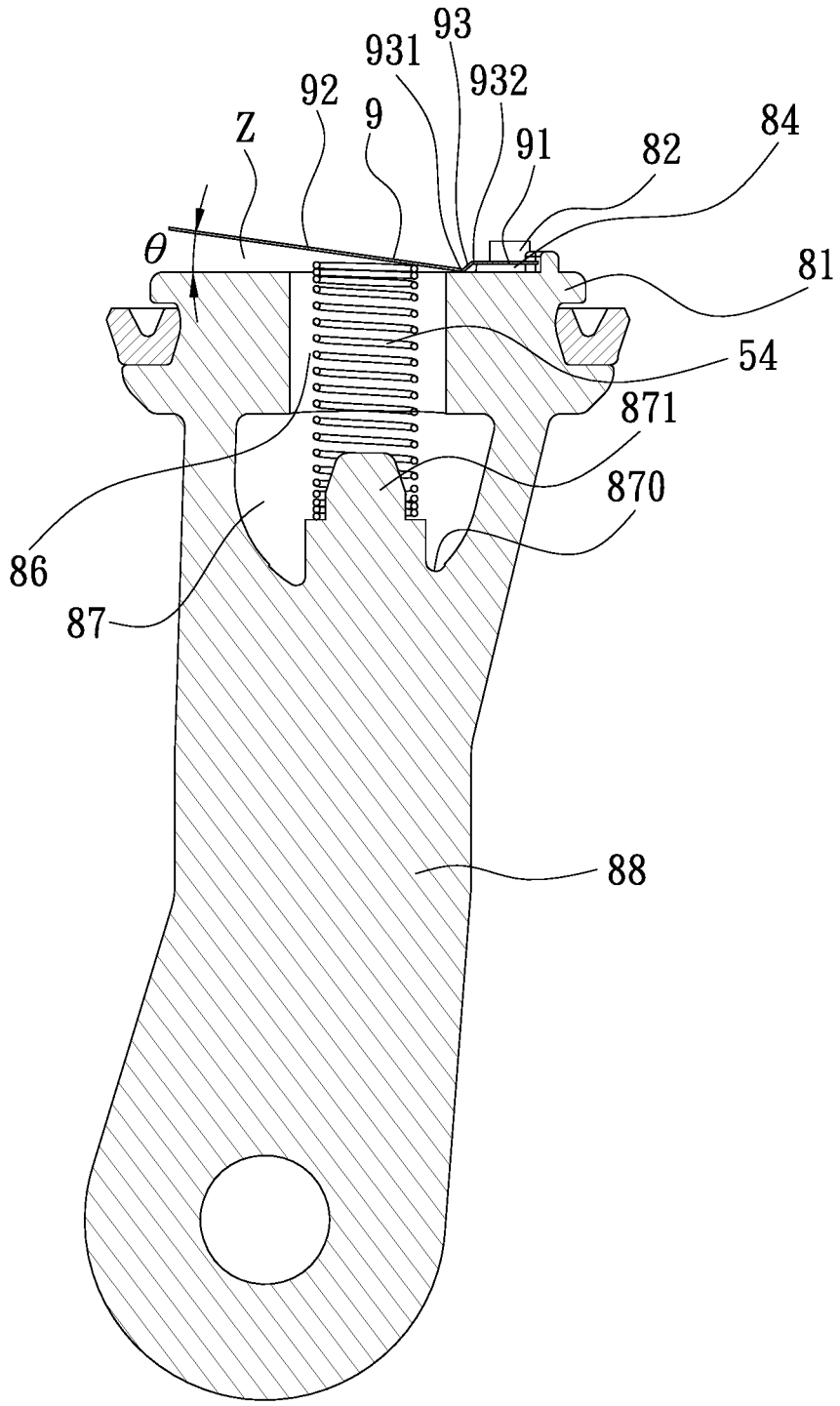
FIG. 8 is a cross sectional view showing the assembly of the piston of the air compressor according to another preferred embodiment of the present invention.
Figure 9:
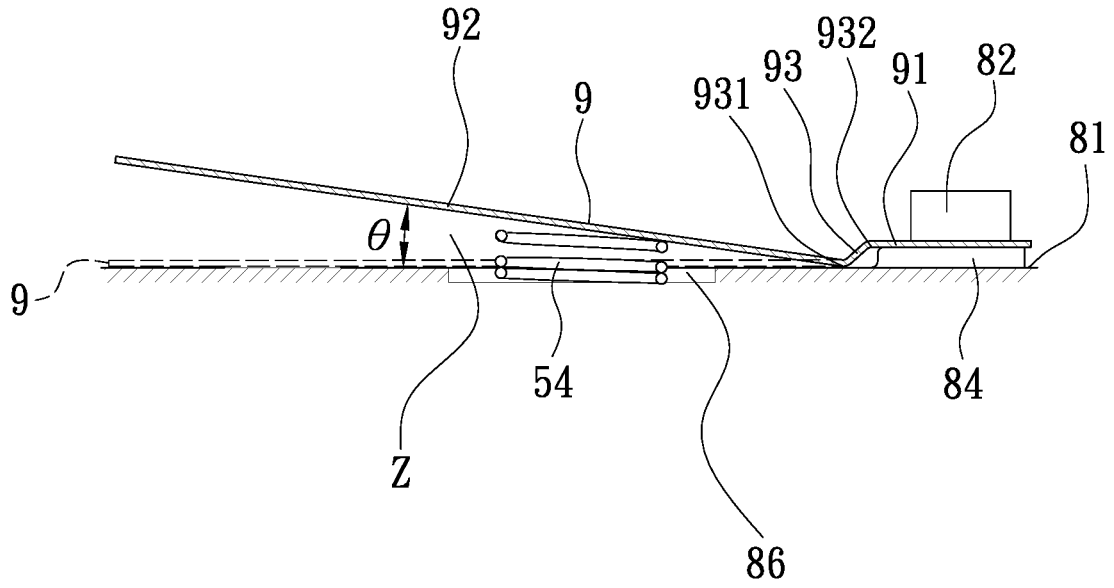
FIG. 9 is an amplified cross sectional view showing the assembly of a part of the piston of the air compressor according to another preferred embodiment of the present invention.

Preferably, a size and a hardness of the air stop sheet 7 are determined based on the output power of the air compressor. Referring to FIGS. 7-9, in another embodiment, to comply with a large output power of the air compressor, an amplitude of the air stop sheet has to be increased by forming a bending section 93 formed in a mechanical working manner, and the bending section 93 has a first collapsible guide line 931 and a second collapsible guide line 932. The air stop sheet 9 has a positioning zone 91 and an acting zone 92 with a height different from a height of the positioning zone 91, wherein the positioning zone 91 of the air stop sheet 9 has two spaced orifices 911, 912, and the two spaced orifices 911, 912 of the positioning zone 91 pass through two separated extensions 82, 83 of a plane of a top of the head 81 and are stopped by two spaced circular shoulders 84, 85. A piston rod 88 extends downward from the head 81, and the piston rod 88 includes a cavity 870 communicating in a top thereof, an air conduit 87 defined in the cavity 870, a column 871 extending from a bottom of the cavity 870, and a spring 54 fitted on the column 871, such that when the air compressor operates in a large output power, the first collapsible guide line 931 abuts against a plane of a top of the head 81, and an open angle θ produces between the acting zone 92 of the air stop sheet 9 and the plane of the top of the head 81. Thereby, when the piston of the air compressor stops, the spring 54 pushes the air stop sheet 9, the acting zone 92 of the air stop sheet 9 lifts relative to the air channel 86 of the piston by using the first collapsible guide line 931, and the air channel 86 of the piston communicates with the air conduit 87 of the piston rod 88 so that a pressure of the cylinder 13 balances with the atmosphere, and the piston is not stopped by an additional resistance (i.e. a back-pressure resistance) in the upward moving stroke after the air compressor 10 is opened again, hence the piston moves in the cylinder 13 smoothly to enhance using safety and service life and to inflate the compressed air into the deflated object easily. Preferably, the air stop sheet 9 has the bending section 93 to be turned on/off, expanded, and retracted smoothly, thus enhancing the service life.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. An air stop sheet of a piston in a cylinder, the piston being accommodated in an air compressor, and the air stop sheet being accommodated on a plane of a top of a head of the piston, the air stop sheet including a bending section;

wherein the bending section has a positioning zone arranged on a first side thereof and located on the plane of the top of the head, and the bending section further has an acting zone arranged on a second side thereof and configured to close an air channel of the head, wherein the bending section is a boundary line of the acting zone of the air stop sheet and the positioning zone of the air stop sheet so that an obtuse angle less than 180 degrees is formed between a top surface of the air stop sheet and the plane of the top of the head, and a back surface of the acting zone of the air stop sheet facing away from the top of the cylinder is lifted relative to the plane of the top of the head at an open angle (θ), thus producing an air flowing space, the open angle (θ) is formed between the back surface and the plane of the top of the head;

wherein a piston rod of the piston extends downward from the head, and the piston rod includes a cavity defined on a top thereof, an air conduit defined in the cavity and communicating with the air channel of the head, a column extending from a bottom of the cavity, and a spring fitted on the column and extending through the air channel of the head along the cavity of the piston rod so that the spring abuts against the back surface of the acting zone of the air stop sheet, the air stop sheet is pushed by the spring to be lifted at the open angle (θ), and the air conduit and the air channel communicate with atmosphere;

wherein the bending section of the air stop sheet has at least one collapsible guide line, the at least one collapsible guide line comprises a first collapsible guide line and a second collapsible guide line, the first collapsible guide line and the second collapsible guide line are located on a side of the plane of the top of the head, when the air stop sheet is lifted, an air flows into or out of the cylinder through a gap between the acting zone of the air stop sheet and the plane of the top of the head, wherein when the acting zone is entirely in contact with the plane of the top of the head, a height of the acting zone is different from a height of the positioning zone, the first collapsible guide line is in contact with the plane of the top of the head, and the second collapsible guide line is distant from the plane of the top of the head, wherein a distance between the first collapsible guide line and the second collapsible guide line is smaller than a distance between the first collapsible guide line and the air channel, the first collapsible guide line stays in place when the acting zone of the air stop sheet is lifted, and the bending section is formed in a mechanical working manner.

2. The air stop sheet of the piston of the cylinder as claimed in claim 1, wherein the head includes two separated bolts, and the positioning zone of the air stop sheet has two spaced orifices connecting with the two separated bolts of the head, thus fixing the air stop sheet on the head;

wherein when the piston of the air compressor stops, the acting zone of the air stop sheet is lifted relative to the plane of the top of the head.

3. The air stop sheet of the piston of the cylinder as claimed in claim 2, wherein the two spaced orifices of the positioning zone are passed through by two separated extensions of the plane of the top of the head and are stopped by two spaced circular shoulders.

* * * * *